US005579920A

United States Patent [19]

Garabedian et al.

[11] Patent Number: 5,579,920

[45] Date of Patent: Dec. 3, 1996

[54] AIR CLEANING MACHINE AND METHOD

[75] Inventors: Michael J. Garabedian; Michael R. Emerzian, both of Fresno, Calif.

[73] Assignee: Garabedian Brothers, Inc., Fresno, Calif.

[21] Appl. No.: 573,612

[22] Filed: Dec. 15, 1995

Related U.S. Application Data

[63] Continuation of Ser. No. 286,120, Aug. 4, 1994, abandoned.

[51] Int. Cl.[6] ..... B07B 4/00

[52] U.S. Cl. ..... 209/139.1; 209/149

[58] Field of Search ..... 209/133, 138, 209/139.1, 140, 141, 142, 146, 147, 149, 246

[56] References Cited

U.S. PATENT DOCUMENTS

| | | | |
|---|---|---|---|
| 27,274 | 2/1860 | Corbin | 209/146 X |
| 1,695,383 | 12/1928 | McCarthy | 209/139.1 X |
| 1,987,640 | 1/1935 | Rothgarn | 209/136 |
| 2,132,961 | 10/1938 | Morgan | 209/139.1 |
| 2,186,167 | 1/1940 | Eissmann | 209/139.1 X |
| 2,204,032 | 6/1940 | Whitlock | 209/147 X |
| 2,679,316 | 5/1954 | Ruepp | 209/139.1 X |
| 2,852,137 | 9/1958 | Hagopian | 209/139.1 |
| 3,593,851 | 7/1971 | Davidson | 209/146 X |
| 4,230,559 | 10/1980 | Smith | 209/139.1 X |
| 4,700,636 | 10/1987 | Vogt et al. | 209/139.1 X |
| 4,832,700 | 5/1989 | Kaspar et al. | 209/138 X |
| 5,103,981 | 4/1992 | Abbott et al. | 209/139.1 X |

FOREIGN PATENT DOCUMENTS

| | | | |
|---|---|---|---|
| 1338901 | 9/1987 | U.S.S.R. | 209/139.1 |

OTHER PUBLICATIONS

Advertising brochure, "VWM large Capacity Raisin Cleaning & Processing Line", Valley Welding and Machine Works.

Advertising brochure, "VWM 1½ to 3 Ton Raising Cleaning & Processing Line", Valley Welding and Machine Works.

Advertising Flyer, "The Best Vacuum Cleaning Equipment Available", Valley Welding and Machine Works.

Advertising Flyer, "Drop–Thru Air Cleaners", Commercial Manufacturing and Supply Company.

Advertising Flyer, "Dewatering and Air Cleaning Unit", Commercial Manufacturing and Supply Company.

*Primary Examiner*—William E. Terrell
*Assistant Examiner*—Tuan Nguyen
*Attorney, Agent, or Firm*—Townsend and Townsend and Crew LLP

[57] ABSTRACT

An air cleaning machine (2) separates a flowable product (28) into first and second components (60, 61) using an air leg (4) having upper and lower ends (6, 8). A vacuum source (10) is coupled to the upper end of the air leg to create a vacuum air flow (62) up through the air leg and into the vacuum chamber (12). The product, such as raisins, almonds or dates, is introduced into the air leg through a product entrance (42) and onto a downwardly sloping screen (44) by a product delivery unit (24). An air knife (50) directs a sharp stream of air (56) upwardly into the air leg and through the product as the product enters the air leg but before the product contacts the screen. The combination of the stream of air from the air knife and the vacuum air flow created by the vacuum source separates the first and second components of the product so that the first component moves upwardly through the air leg and into the vacuum chamber while the second component passes downwardly out through the lower end of the air leg.

30 Claims, 3 Drawing Sheets

AIR CLEANING MACHINE AND METHOD

This is a Continuation of application No. 08/286,120, filed Aug. 4, 1994, now abandoned.

BACKGROUND OF THE INVENTION

Many products, especially agricultural products such as raisins, dates and almonds, require cleaning. Cleaning often includes separating the heavier components from the lighter components. Since the desired product is commonly heavier than the material to be separated from the product, called debris, this separation is commonly done using airflow.

The simplest way of doing this is with a system called a blower. A relatively high volume blower is used to create an air flow through which the product to be cleaned is poured, like a waterfall. The cleaned product, being heavier, passes generally straight down through the air flow into a waiting container, onto a conveyer belt, etc. The lighter debris is carried away by the air flow and is typically collected in a debris collection hopper.

A second way of cleaning product uses an air leg. The product to be cleaned introduced into the lower portion of the vertically extending air leg, the air leg having a blower at its lower end. The blower provides a high volume air flow up through the air leg which passes through the product to be cleaned. The product is supported within the air leg on an angled screen so that the product continues down along the screen and exits the air leg while the lighter debris is separated out from the product and passes up through the air leg where the debris is collected, such as in a debris box.

A third conventional method uses a vacuum chamber in which a partial vacuum is created by a vacuum exhaust fan. The vacuum chamber is coupled to the upper end of a vacuum air leg. The lower end of the vacuum air leg overlies one end of a conveyor supporting the product to be cleaned. As the product to be cleaned passes under the lower end of the vacuum air leg, the lighter debris is pulled up into the vacuum air leg while the heavier product continues along the conveyor, falls off the end of the conveyor and is collected. When the separated light debris enters the vacuum chamber, the air speed drops suddenly so that the light debris then drops down and collects above an air lock which allows the debris to pass into a debris bin. The air lock, similar to a revolving door used at the entrances of stores and buildings, is used to minimize the seepage of air up in through the air lock while allowing the collected debris to pass out of the vacuum chamber. If an air lock were not used the vacuum exhaust fan would need to be much larger to get the same air flow through the vacuum air leg.

SUMMARY OF THE INVENTION

The present invention is directed to an air cleaning machine and a method for its use which uses an air knife to inject a narrow, fast stream of air up through a flowable product as it enters the air leg to facilitate the separation of the flowable product into a first component, which will be pulled up into the air leg, and a second component, which will continue moving downwardly and out of the air leg. This use of the air knife drastically improves the separation of the first and second components using a reasonable amount of power to do so. The invention accomplishes a degree of separation in a single pass through the machine which would take a number passes through conventional air cleaning machines using equivalent amounts of power.

The air cleaning machine separates the flowable product into first and second components using an air leg having an upper and lower end. An air flow source is coupled to the air leg to create an air flow up through the air leg and through the upper end of the air leg. The flowable product, such as raisins, almonds or dates, is introduced into the air leg at a product entrance by a product delivery unit. An air knife directs a stream of air upwardly into the air leg and through the product flowing into the air leg. The combination of the stream of air from the air knife and the air flow created by the air flow source separates the first and second components of the products so that the first component moves upwardly through the air leg and through the upper end of the air leg while the second component passes down and out of the air leg, typically through the lower, open end of the air leg.

The air source is preferably a vacuum source coupled to the upper end of the air leg. The vacuum source typically includes a vacuum chamber having a vacuum exhaust fan near its upper end and an air lock at its lower end. The first component, typically debris when dealing with agriculture products, is collected in the lower region of the vacuum chamber and passes out through the air lock into, for example, an awaiting debris bin for disposal.

The product delivery unit typically uses an air lock through which the product passes. The air lock helps to prevent excess leakage of the air and helps to control the speed at which product is introduced into the air leg. The product delivery unit also preferably has an adjustable, downwardly sloping product delivery pan. The product delivery pan can be adjusted to vary its slope thus adjusting the speed at which the product is introduced into the air leg.

A downwardly sloping product screen is preferably used below the product entrance in the air leg to support the product as it passes into the air leg and to help separate the first and second components.

The air knife outlet is preferably positioned between the product entrance and the upper edge of the product screen so that the sharp air flow from the air knife passes up through the product as it enters the air leg but prior to contacting the product screen. This creates an initial separation region above the screen to maximize the effectiveness of the air cleaning. Without the air knife, the product would need to be run through the air cleaning machine about four times to get the same cleaning effectiveness as with the air knife operating. This is because the typically lighter first component has tendency to get carried along with the typically heavier second component and not enter the upwardly moving air stream within the vacuum air leg. This is partially due to the rapid rate that which product is passed through the air cleaning machine and is also due to the downward movement of the product against the direction of the air flow.

Other features and advantages of the invention will appear from following description in which the preferred embodiment has been set forth in detail in conjunction with the accompanying drawing.

DESCRIPTION OF THE PREFERRED EMBODIMENT

Figure 1:
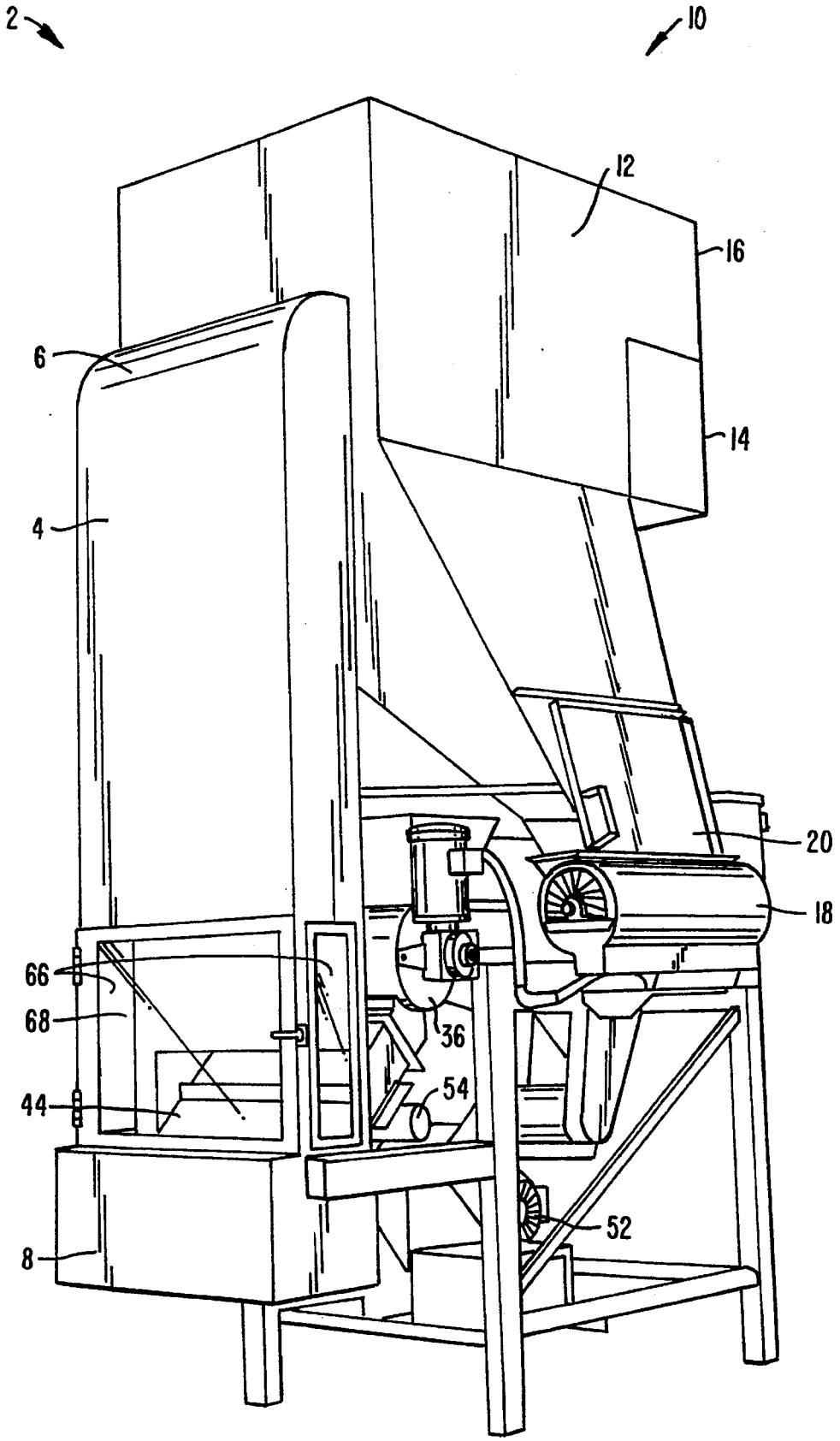
FIG. 1 is a perspective view of an air cleaning machine made according to the invention.
Figure 2:
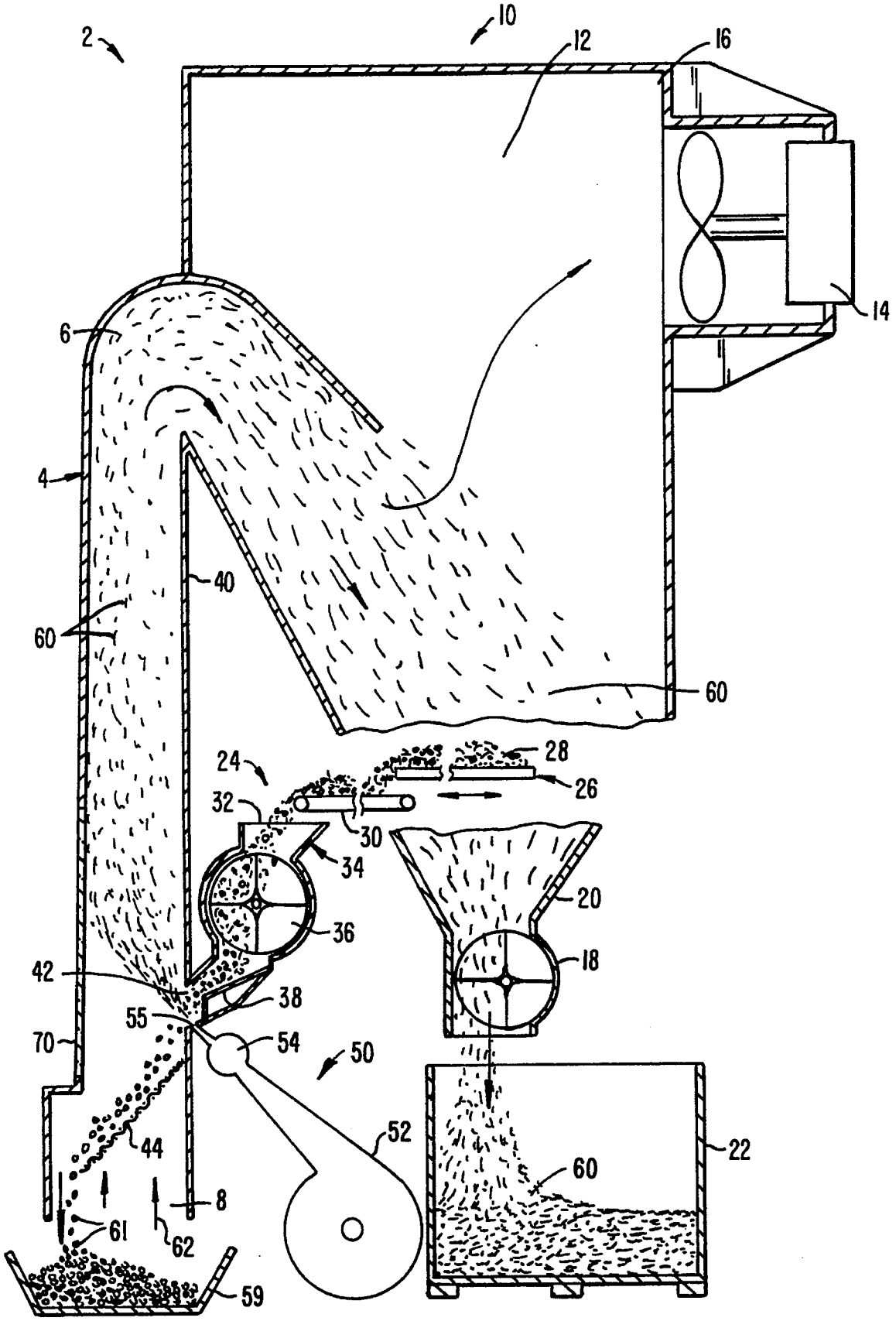
FIG. 2 is a schematic illustration of the machine of FIG. 1.
Figure 3:
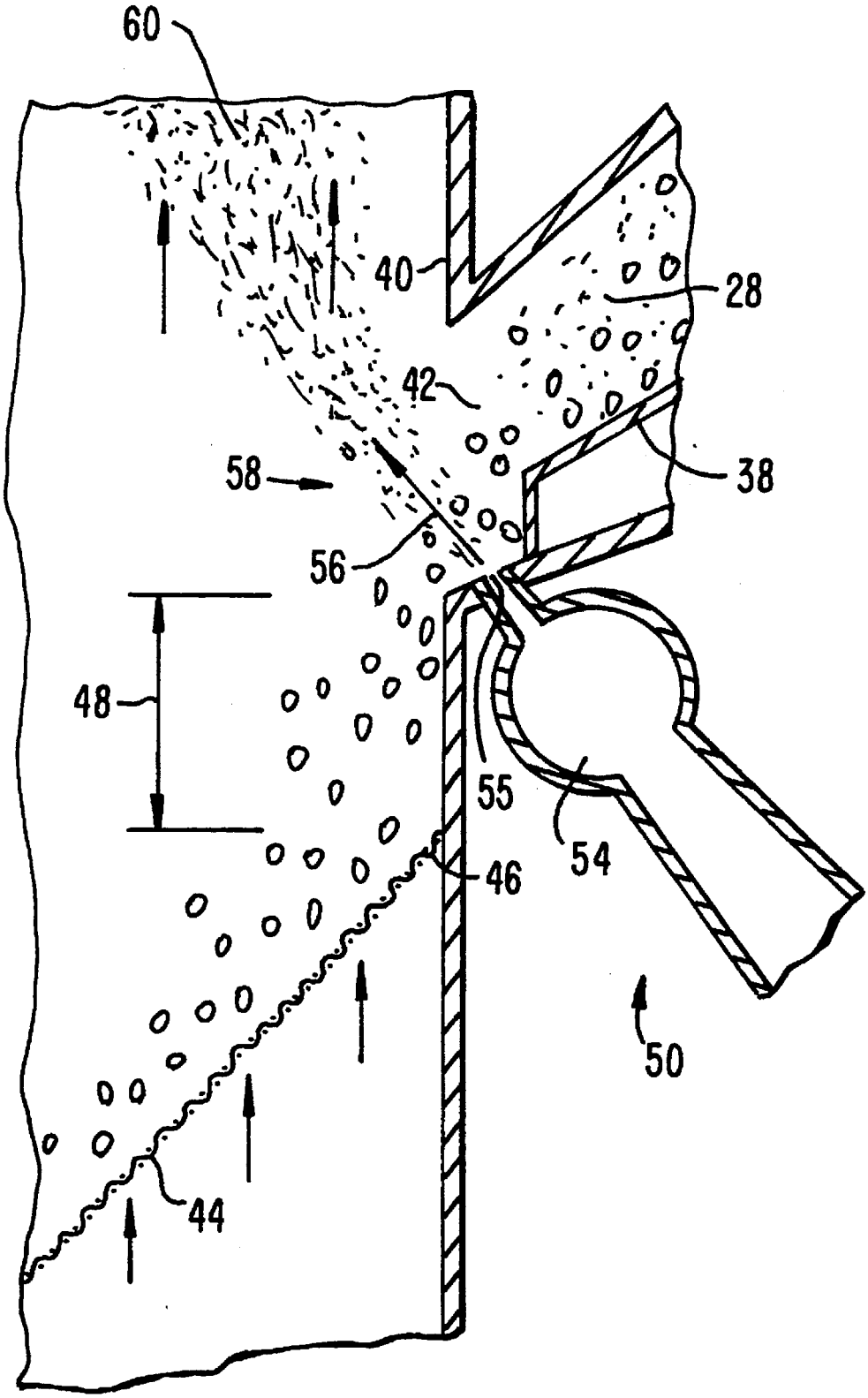
FIG. 3 is an enlarged view illustrating the product and entrance and air knife outlet of the machine of FIG. 2.

FIGS. 1–3 illustrate an air cleaning machine 2 having an air leg 4, with an upper end 6 and an open lower end 8, and a vacuum source 10, including a vacuum chamber 12 connected to upper end 6 of air leg 4. Vacuum chamber 12 is generally conventional and includes a vacuum exhaust fan 14 mounted to the upper portion 16 of vacuum chamber 12. An air lock 18 is positioned at the lower portion 20 of vacuum chamber 12. Air lock 18 permits material to pass from vacuum chamber 12 into, typically, an awaiting debris bin 22 with a minimum of air leakage into chamber 12.

Machine 2 also includes a product delivery unit 24 having a shaker table 26, onto which product 28 is deposited, and a conveyer 30, which passes product from shaker table 26 to the inlet 32 of a product delivery housing 34. Product delivery housing 34 has a motor-driven air lock 36 which directs product 28 on a product delivery pan 38 of product delivery housing 34. Air leg 4 is generally rectangular in cross section and has a flat inner wall 40 with a laterally elongate product entrance 42 formed therein at the termination of product delivery housing 34.

A downwardly sloping product screen 44 is mounted within air leg 4 below product entrance 42. The upper edge 46 of product screen 44 is positioned a distance 48 below product entrance 42. The mesh size and inclination angle of product screen 44 will depend on various factors including the air flow rate created by vacuum exhaust 14, the product being cleaned, the speed in which the product is passed through machine, etc. However, for cleaning agricultural products such as raisins, a 3/16 inches diameter on ¼ inch centers screen 44 at a 40–50 degree angle has proven effective when product is delivered at 7–20 tons per hour through a product entrance 42 30–60 inches wide, screen 44 located 12–24 inches below entrance 42.

Air cleaning machine 2 also includes an air knife 50 comprising an air injection blower 52 coupled to a manifold 54 extending across the entire width of wall 40 and thus the entire width of product entrance 42. Manifold 54 opens into a narrow air knife outlet 55 formed in wall 40 between upper edge 46 of product screen 44 and product entrance 42. Air knife 50 is configured to provide an upwardly flowing sharp stream of air 56 which flows into the interior of air leg 4 and through product 28 at an initial separation region 58. Assuming product 28 is uncleaned raisins, that is bits of stem, small shriveled raisins and other material which need to be separated from the heavier, good raisins, we can consider the product to include a first component which will be pulled up into air leg 4 as the debris and the second component which will continue down air leg 4 and into a waiting bin 59. Air stream 56 tends to break up the flow of product 28 at initial separation region 58 thus freeing the first component 60 (typically the debris) from being entrained with the second component 61 (typically the cleaned product, such as raisins). This permits the vacuum air flow 62 being pulled in through lower end 8 of air leg 4 together with air stream 56 to entrain first component 60 within the upwardly moving air flow in air leg 4 for movement into vacuum chamber 12. Air leg 4 narrows between product entrance 42 and upper end 6 to increase the velocity of the air flow through air leg 4 as the air flow enters vacuum chamber 12. When the air flow and entrained first component 60 enters vacuum chamber 12, the velocity suddenly drops permitting the first component to drop down into lower portion 20 and through air lock 18.

To change the angle of product delivery pan 38, pan 38 can be replaced with a pan which changes the chosen distance 48, making distance 48 larger, which would decrease the angle and thus slow the movement of product 28, or making distance 48 smaller, which would increase the angle and thus speed the movement of product 28. For example, if air cleaning machine 2 were to be used to clean dates, distance 48 could be shortened thus increasing the angle of pan 38 since dates have a tendency not to flow as freely as, for example, raisins or almonds. If air cleaning machine 2 were to be used to clean, for example, marbles from fibrous packing material, distance 48 may be increased to slow the movement of product 28 since marbles have a tendency to move quite rapidly down an incline.

As seen best in FIG. 1, air leg 4 has viewing windows 66 along its lateral sides adjacent product entrance 42 and a glass door 68 along the outer wall 70 of air leg 4 so the user can watch the separation action, especially at initial separation region 58. This permits the user to adjust the various operating parameters, such as the speed of exhaust fan 14, the speed of blower 52 and the rate of flow of product 28. Other parameters, such as changing distance 48 thus changing the angle of delivery pan 38 can also be made. The angle and type of product screen 44 can also be changed to suit the particular product and the condition of the product.

An air cleaning machine 2 suitable for separating 10 tons of raisins per hour would typically have a 7.5 horsepower vacuum exhaust fan capable of pulling about 7020 cfm air through upper end 6 of air leg 4. Air injection blower 52 will typically be a driven by a 5 horsepower motor to blow about 1375 cfm of air through a 3/16-inch by 34-inch long air knife outlet 55. The speeds of vacuum exhaust fan 14, air injection blower 52 and the rotational speeds of air locks 18, 36 are preferably adjustable. These components result in an air flow through air knife outlet 55 which is about 15–20% of the air flow through upper end 6 of air leg 4 at a rate of speed about 10 times the air flow speed through upper end 6.

In use, product 28 is delivered to shaker table 26 which causes product 28 to flow onto conveyor 30 which delivers the product to inlet 32 of product delivery housing 34. With exhaust fan 14, and air injection blower 52 operating, as well as air locks 18 and 36 being driven, product 28 passes through air lock 36, down product delivery pan 38, through product entrance 42 and then to initial separation region 58. At region 58 product 28 is affected by vacuum air flow 62 but primarily by air stream 56 passing through air knife outlet 55. Air stream 56 breaks apart or separates the flow of product 28 as it initially enters air leg 4 to permit first component 60 to be entrained by the air stream flowing upwardly through air leg 4. Second component 61 passes through end 8 of air leg 4 and into bin 59 while first component 60 passes through air lock 18 and into debris bin 22.

While the invention finds particular utility for use with agricultural crops, the invention can be used for separating components of other materials in which one component is more easily entrained within air flow than the other. Usually the component which is more easily entrained in air flow is lighter than the other component. However, based on the size, shape and density of the components, the lighter component may be that which drops down through the lower end 8 of air leg 4 while the heavier component gets entrained within the air stream flowing up through the air leg. Therefore, first component 60, which is entrained within the air leg 4, need not be lighter than second component 61.

Other modifications and variation can be made to the disclosed embodiment without departing from the subject of the invention as defined in the following claims. For example, air flow 62 from vacuum exhaust fan 14 could be created or supplemented by a blower mounted below screen 44. Also, second component 61 could exit through an opening in outer wall 70 of air leg 4 rather than through open, lower end 8 of the air leg.

What is claimed is:

1. An air cleaning machine for separating a flowable product into first and second components comprising:

an air leg having an upper end and a lower end;

an air flow source coupled to the air leg thereby creating an air flow up the air leg and through the upper end of the air leg;

a product entrance along the air leg;

a product screen extending downwardly from a first position, the first position located below the product entrance;

a product exit along the air leg;

a product delivery unit configured to deliver product to the product entrance so to introduce a flow of the product into the air leg; and an air knife having an air knife outlet, positioned below the product entrance and above the first position, adapted to inject a stream of air upwardly into the air leg and through the flow of the product;

whereby the first and second components are separated with the first component flowing up the air leg and through the upper end while the second component passes through the product exit.

2. A method for separating a first component of a flowable product from a second component of the flowable product comprising the following steps:

creating an air flow from lower end of an air leg to an upper end of the air leg;

introducing a flow of the product into the air leg at a product entrance along the air leg;

passing the product over a downwardly inclined screen within the air leg; and injecting a stream of air upwardly into the air leg and through the flow of the product prior to the product contacting the screen;

whereby the first and second components are separated within the air leg with the first component being pulled up the air leg and through the upper end while the second component passes through the lower end.

3. A method for separating a first component of a flowable product from a second component of the flowable product comprising the following steps:

creating an air flow from lower end of an air leg to an upper end of the air leg using a vacuum chamber coupled to the upper end of the air leg;

introducing a flow of the product into the air leg at a product entrance along the air leg;

passing the product over a downwardly inclined screen within the air leg; and injecting a stream of air upwardly into the air leg and through the flow of the product prior to the product contacting the screen;

whereby the first and second components are separated within the air leg with the first component being pulled up the air leg and through the upper end while the second component passes through the lower end.

4. The method of claim 3 wherein the introducing step includes the step of flowing the product on a product delivery pan prior to reaching the product entrance; and further comprising the step of varying the inclination angle of the product delivery pan to control the speed of movement of the product passing into the air leg.

5. An air cleaning machine for separating a flowable product into first and second components comprising:

an air leg having an upper end and a lower end;

a product entrance along the air leg;

an air entrance situated below the product entrance;

an air flow source coupled to the air leg thereby creating a first, lesser speed air flow from the air entrance up the air leg and through the upper end of the air leg;

a product exit along the air leg;

an initial separation region adjacent to the product entrance;

a product delivery unit configured to deliver product to the product entrance so to introduce a flow of the product into the air leg at the initial separation region; and an air knife having an air knife outlet positioned below the product entrance adapted to inject a second, higher speed flow upwardly into the first air flow in the air leg and through the flow of the product at the initial separation region so to initially separate the first and second components at the initial separation region;

whereby the first and second components are separated with the first component flowing up the air leg and through the upper end while the second component passes through the product exit.

6. The machine of claim 5 wherein the air flow source includes a vacuum source coupled to the upper end of the air leg.

7. The machine of claim 6 wherein the vacuum source includes a vacuum chamber having an upper portion, a lower portion, a vacuum exhaust fan which creates a vacuum within the vacuum chamber, and an air lock at the lower portion through which the first component passes out of the vacuum chamber.

8. The machine of claim 5 wherein the air leg has a smaller cross-sectional area at the upper end than at the product entrance.

9. The machine of claim 5 further comprising a product screen extending downwardly from a first position, the first position located below the product entrance.

10. The machine of claim 9 wherein the air knife outlet is positioned above the first position.

11. The machine of claim 5 wherein the air flow volume of the second air flow from the air knife is about 15% to 20% of the air flow volume passing through the upper end of the air leg.

12. The machine of claim 5 wherein the air flow speed of the stream of air from the air knife at the air knife outlet is about 10 times the air flow speed at the upper end of the air leg.

13. The machine of claim 5 wherein the air leg at the product entrance has a wall and the stream of air from the air knife extends across at least substantially all of the wall.

14. The machine of claim 5 wherein the air leg at the product entrance has a wall.

15. The machine of claim 14 wherein the air knife outlet is aligned with the wall.

16. The machine of claim 14 wherein the wall is flat.

17. The machine of claim 5 wherein the product delivery unit includes a product delivery pan, on which the product moves prior to passing through the product entrance, positionable at different angular orientations so to permit the speed of the introduction of the product into the air leg to be changed.

18. The machine of claim 5 wherein the air knife outlet is spaced apart from the product entrance by a chosen distance.

19. The machine of claim 18 wherein the chosen distance is about 1.5 inches.

20. The machine of claim 5 wherein the lower end is open and defines the product exit.

21. A method for separating a first component of a flowable product from a second component of the flowable product comprising the following steps:

creating a first, lesser speed, larger volume air flow from a first air entrance, located below a product entrance along an air leg, to an upper end of the air leg;

introducing a flow of the product into the air leg at the product entrance along the air leg; and initially separating the first and second components at an initial separation region adjacent to the product entrance by injecting a second, higher speed, lower volume air flow upwardly from a second air entrance, located below the product entrance, and into the first air flow in the air leg and through the flow of the product at the initial separation region;

whereby the first and second components are separated within the air leg with the first component being pulled up the air leg and through the upper end while the second component passes through the lower end.

22. The method of claim 21 wherein the air flow creating step is carried out using a vacuum chamber coupled to the upper end of the air leg.

23. The method of claim 22 further comprising the steps of collecting the first component within the vacuum chamber and passing the collected first component from the vacuum chamber through an air lock.

24. The method of claim 21 wherein the introducing step includes the step of passing the product through an air lock prior to reaching the product entrance.

25. The method of claim 21 wherein the introducing step includes the step of flowing the product on a product delivery pan prior to reaching the product entrance.

26. The method of claim 25 further comprising the step of varying the inclination angle of the product delivery pan to control the speed of movement of the product passing into the air leg.

27. The method of claim 21 further comprising the step of passing the product over a downwardly inclined screen within the air leg.

28. The method of claim 27 wherein the air stream injecting step is carried out prior to the product contacting the screen.

29. An air cleaning machine for separating a flowable product into first and second components comprising:

an air leg having an upper end and an open lower end;

a vacuum source coupled to the upper end of the air leg thereby creating an air flow up the air leg and through the upper end of the air leg;

a product entrance along the air leg;

a product delivery unit configured to deliver product to the product entrance so to introduce a flow of the product into the air leg;

a product screen extending downwardly from a first position below the product entrance;

an air knife having an air knife outlet positioned a chosen distance below the product entrance and above the product screen, the air knife adapted to inject a stream of air upwardly into the air leg and through the flow of the product;

whereby the first and second components are separated with the first component flowing up the air leg and through the upper end while the second component passes through the lower end; and the vacuum source including a vacuum chamber having an upper portion, a lower portion, a vacuum exhaust fan which creates a vacuum within the vacuum chamber, and an air lock at the lower portion through which the first component passes out of the vacuum chamber.

30. The machine of claim 29 wherein:

the air flow volume of the stream of air from the air knife is about 15% to 20% of the air flow volume passing through the upper end of the air leg; and the air flow speed of the stream of air from the air knife at the air knife outlet is about 10 times the air flow speed at the upper end of the air leg.

* * * * *